US010333281B2

(12) United States Patent
Nakano et al.

(10) Patent No.: US 10,333,281 B2
(45) Date of Patent: Jun. 25, 2019

(54) SPARK PLUG

(71) Applicant: DENSO CORPORATION, Kariya, Aichi-pref. (JP)

(72) Inventors: Kazumi Nakano, Kariya (JP); Masamichi Shibata, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/028,569

(22) Filed: Jul. 6, 2018

(65) Prior Publication Data

US 2019/0020179 A1 Jan. 17, 2019

(30) Foreign Application Priority Data

Jul. 11, 2017 (JP) ..... 2017-135475

(51) Int. Cl.

*H01T 13/32* (2006.01)
*H01T 13/14* (2006.01)
*H01T 13/46* (2006.01)

(52) U.S. Cl.

CPC ..... *H01T 13/14* (2013.01); *H01T 13/32* (2013.01); *H01T 13/462* (2013.01)

(58) Field of Classification Search

CPC ..... H01T 13/14; H01T 13/462; H01T 13/32; H01T 13/20

See application file for complete search history.

(56) References Cited

U.S. PATENT DOCUMENTS 4,439,707 A * 3/1984 Hattori ..... H01T 13/39 313/130
5,929,556 A * 7/1999 Matsubara ..... H01T 13/52 313/139
6,628,050 B1 * 9/2003 Kameda ..... H01T 13/20 313/141
9,093,823 B2 * 7/2015 Sakakura ..... H01T 13/32
2007/0216276 A1 * 9/2007 Takada ..... H01T 13/20 313/141
2007/0252503 A1 * 11/2007 Rossi ..... H01T 13/20 313/141
2009/0066211 A1 * 3/2009 Hartmann ..... H01T 13/20 313/141
2009/0309474 A1 * 12/2009 Nunome ..... H01T 13/20 313/141
2011/0025186 A1 * 2/2011 Kunitomo ..... H01T 13/20 313/141
2012/0001533 A1 * 1/2012 Sakayanagi ..... H01T 13/20 313/141
2014/0015398 A1 * 1/2014 Sakakura ..... H01T 13/20 313/140

(Continued)

*Primary Examiner* — Donald L Raleigh
(74) *Attorney, Agent, or Firm* — Nixon & Vanderhye P.C.

(57) ABSTRACT

A spark plug is provided which includes a cylindrical metal shell, a cylindrical porcelain insulator retained in the metal shell, a center electrode, and a ground electrode. The center electrode is disposed in the insulator with a head protruding outside a front end surface of the insulator. The ground electrode is joined to the metal shell and includes a gap-defining portion which faces a side surface of a side surface of the center electrode to define a spark gap and also faces the front end surface of the porcelain insulator to define a semi-surface discharge gap for burning off, for example, carbon deposits on the front end surface of the insulator.

12 Claims, 8 Drawing Sheets

(56) References Cited

U.S. PATENT DOCUMENTS

| | | | | |
|---|---|---|---|---|
| 2014/0021853 | A1* | 1/2014 | Shimizu | H01T 13/20 313/141 |
| 2014/0042893 | A1* | 2/2014 | Sakakura | H01T 13/32 313/144 |
| 2016/0079739 | A1* | 3/2016 | Okazaki | H01T 13/20 313/143 |
| 2017/0077680 | A1* | 3/2017 | Chirila | H01T 13/467 |
| 2018/0166863 | A1* | 6/2018 | Sumoyama, Sr. | H01T 13/20 |

* cited by examiner

SPARK PLUG

CROSS REFERENCE TO RELATED DOCUMENT

The present application claims the benefit of priority of Japanese Patent Application No. 2017-135475 filed on Jul. 11, 2017, the disclosure of which is incorporated herein by reference.

BACKGROUND

1. Technical Field

This disclosure relates generally to a spark plug designed to have an enhanced self-cleaning feature.

2. Background Art

Japanese Patent No. 3272615 teaches a spark plug which has a center electrode and a ground electrode. The center electrode is firmly installed in an axial hole of a porcelain insulator with a head thereof protruding outside an end of the porcelain insulator. The ground electrode is disposed on an end of a metal shell and has a surface of a head directly facing a side surface of the head of the center electrode. The spark plug has a spark gap between the surface of the head of the ground electrode and the side surface of the head of the center electrode. The spark plug usually works to create a spark between the surface of the head of the ground electrode and the side surface of the head of the center electrode. When fouled, the spark plug creates a semi-surface discharge between the ground electrode and the side surface of the head of the center electrode along the surface of the head of the porcelain insulator.

The above spark plug, however, has a short spark path of the semi-surface discharge along the surface of the head of the porcelain insulator when the spark plug is fouled, thus having a limited ability to burn off carbon deposits on the surface of the head of the porcelain insulator.

SUMMARY

It is therefore an object of this disclosure to provide a spark plug which has an enhance ability to turn off deposits of, for example, carbon on an end surface of a porcelain insulator.

According to one aspect of the invention, there is provided a spark plug which comprises: (a) a cylindrical metal shell; (b) a cylindrical porcelain insulator which is retained inside the metal shell; (c) a center electrode which is disposed inside the porcelain insulator to have a head protruding outside a front end surface of the porcelain insulator; and (d) a ground electrode which is joined to the metal shell and has a gap-defining portion. The gap-defining portion extends along a side surface of the center electrode and the front end surface of the porcelain insulator.

In operation, the spark plug works to produce a spark between the ground electrode joined to the metal shell and the center electrode disposed in the porcelain insulator to ignite an air-fuel mixture.

The head of the center electrode, as described above, protrudes outside the front end surface of the porcelain insulator. The ground electrode has the gap-defining portion which extends along the side surface of the center electrode and the front end surface of the porcelain insulator, in other words, which faces the side surface of the center electrode and the front end surface of the porcelain insulator. This creates a first spark gap between the side surface of the center electrode and the gap-defining portion of the ground electrode for producing a spark in a normal operation mode of the spark plug and also creates a second spark gap between the front end surface of the porcelain insulator and the gap-defining portion of the ground electrode for achieving semi-surface discharge in a fouling mode of the spark plug. In the normal operating mode where a small amount of deposit of, example, carbon accumulates on the front end surface of the porcelain insulator, the spark plug works to produce a spark in the first spark gap to ignite an air-fuel mixture In the fouling mode where a large amount of deposit of, for example, carbon, accumulates on the front end surface of the porcelain insulator, the spark plug works to achieve the semi-surface discharge in the second spark gap on the front end surface of the porcelain insulator to burn off the deposit on the front end surface of the porcelain insulator. The gap-defining portion extends over the front end surface of the porcelain insulator, thereby resulting in an increased region where the front end surface of the porcelain insulator faces the gap-defining portion, which leads to an increased length of a path in which the spark is developed along the front end surface of the porcelain insulator in the fouling mode, thereby enhancing the ability of the spark plug to burn off the deposit on the front end surface of the porcelain insulator.

If the ground electrode extends straight from the circumference of the metal shell toward the center electrode, the ground electrode has a portion which faces the front end surface of the porcelain insulator and has a length which is less than or equal to the width of the front end surface in a radial direction of the porcelain insulator. This results in a decreased length of a path along which the semi-surface discharge is developed along the front end surface of the porcelain insulator in the fouling mode, which leads to an insufficient amount of deposit burned off on the front end surface of the porcelain insulator.

In the preferred mode of this disclosure, the gap-defining portion may have a length which extends over the front end surface of the porcelain insulator and is selected to be greater than a width of the front end surface of the porcelain insulator in a radial direction of the porcelain insulator. This results in an increased length of the path in which the semi-surface discharge is developed in the fouling mode, thereby enhancing the ability of the spark plug to burn off the deposits on the front end surface of the porcelain insulator.

The spark plug may alternatively be designed to have the gap-defining portion which has a length extending over the front end surface of the porcelain insulator and selected to be greater than half an outer diameter of the porcelain insulator. This results in an increased length of the path along which the semi-surface discharge is developed in the fouling mode, thereby enhancing the ability of the spark plug to burn off the deposits on the front end surface of the porcelain insulator.

The spark plug may be designed to have the gap-defining portion which defines a first gap that is a minimum gap between the gap-defining portion and the side surface of the center electrode. The first gap is selected to be more than or equal to 0.4 mm and less than or equal to 0.8 mm. The defining portion may also define a second gap that is a minimum gap between the gap-defining portion and the front end surface of the porcelain insulator. The second gap is selected to be more than or equal to 0.2 mm and less than or equal to the first gap. This ensures the stability in producing sparks between the side surface of the center electrode and the gap-defining portion in the normal operating mode.

The second gap that is a minimum air gap between the front end surface of the porcelain insulator and the gap-defining portion is selected to be 0.2 mm or more. This eliminates a probability that the semi-surface discharge is undesirably developed in the second gap along the front end surface of the porcelain insulator when the insulation resistance of the porcelain insulator is decreased with an increase in temperature thereof. The second gap is smaller in size than the first gap, thereby causing the semi-surface discharge to be initiated in the second gap when the fouling mode is entered without generating sparks in the first gap.

The spark plug may be designed to have a ground electrode which is shaped to straight extend. This facilitates the ease with which the ground electrode is joined to the metal shell in a production process of the spark plug.

The spark plug may also include a second ground electrode extending parallel to a first ground electrode that is the above ground electrode on opposite sides of the center electrode. The first and second ground electrodes may extend parallel to each other. This results in an increased region where the front end surface of the porcelain insulator faces the first and second ground electrodes as compared with when the spark plug is equipped with only one ground electrode, thereby improving the ability of the spark plug to burn off, for example, carbon deposits on the front end surface of the porcelain insulator.

The first and second ground electrodes may extend from portions of the metal shell which are diametrically opposed to each other. This facilitates the ease with which the ground electrodes are joined to the metal shell in the production process of the spark plug as compared with when the ground electrodes extend from portions of the metal shell which are located closer to each other in the circumferential direction of the metal shell.

According to another aspect of the invention, there is provided a spark plug which comprises: (a) a cylindrical metal shell; (b) a cylindrical porcelain insulator which is retained inside the metal shell; (c) a center electrode which is disposed inside the porcelain insulator to have a head protruding outside a front end surface of the porcelain insulator; and (d) a ground electrode which extends at a given angle to a line, as defined to extend from a front circumference of the metal shell to the center electrode, when tips of the metal shell and the center electrode are viewed in a longitudinal direction of the spark plug. The given angle is selected to be greater than 0° and less than 45°. The ground electrode is oriented to face a side surface of the center electrode and the front end surface of the porcelain insulator.

If the ground electrode is designed to extend straight from the circumference of the metal shell toward the center electrode, the ground electrode has a portion which faces the front end surface of the porcelain insulator and has a length which is less than or equal to the width of the front end surface in a radial direction of the porcelain insulator.

In the above structure according to the second aspect of this disclosure, when the tips of the metal shell and the center electrode are viewed in the longitudinal direction of the spark plug, the ground electrode extends at the angle of 0° to 45° to a line defined to extend from the circumference of the metal shell to the center electrode. The ground electrode is oriented to face the side surface of the center electrode in the radial direction of the spark plug and also face the front end surface of the porcelain insulator in the longitudinal direction of the spark plug. These arrangements result in an increase in length of the ground electrode which faces or overlaps the front end surface of the porcelain insulator in the longitudinal direction of the spark plug as compared with an example wherein the ground electrode extends from the end of the metal shell straight toward the center electrode. The structure of the spark plug, therefore, has the long path in which the semi-surface discharge is developed over the front end surface of the porcelain insulator when the front end surface is fouled with, for example, carbon deposits, thereby enhancing the ability of the spark plug to burn off the carbon deposits on the front end surface of the porcelain insulator.

The ground electrode may have a length which extends over the front end surface of the porcelain insulator and is selected to be greater than a width of the front end surface of the porcelain insulator in a radial direction of the porcelain insulator. This results in an increased length of the path in which the semi-surface discharge is developed in the fouling mode, thereby enhancing the ability of the spark plug to burn off the carbon deposits on the front end surface of the porcelain insulator.

The spark plug may alternatively be designed to have the ground electrode which has a length extending over the front end surface of the porcelain insulator and selected to be greater than half an outer diameter of the porcelain insulator. This results in an increased length of the path in which the semi-surface discharge is developed in the fouling mode, thereby enhancing the ability of the spark plug to burn off the deposits on the front end surface of the porcelain insulator.

The spark plug may be designed to have the ground electrode which is shaped to straight extend. This facilitates the ease with which the ground electrode is joined to the metal shell in a production process of the spark plug.

The spark plug may also include a second ground electrode extending parallel to a first ground electrode that is the above ground electrode on opposite sides of the center electrode. The first and second ground electrodes may extend parallel to each other. This results in an increased region where the front end surface of the porcelain insulator faces the first and second ground electrodes as compared with when the spark plug is equipped with only one ground electrode, thereby improving the ability of the spark plug to burn off, for example, carbon deposits on the front end surface of the porcelain insulator.

The first and second ground electrodes may extend from portions of the metal shell which are diametrically opposed to each other. This facilitates the ease with which the ground electrodes are joined to the metal shell in the production process of the spark plug as compared with when the ground electrodes extend from portions of the metal shell which are located closer to each other in the circumferential direction of the metal shell.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
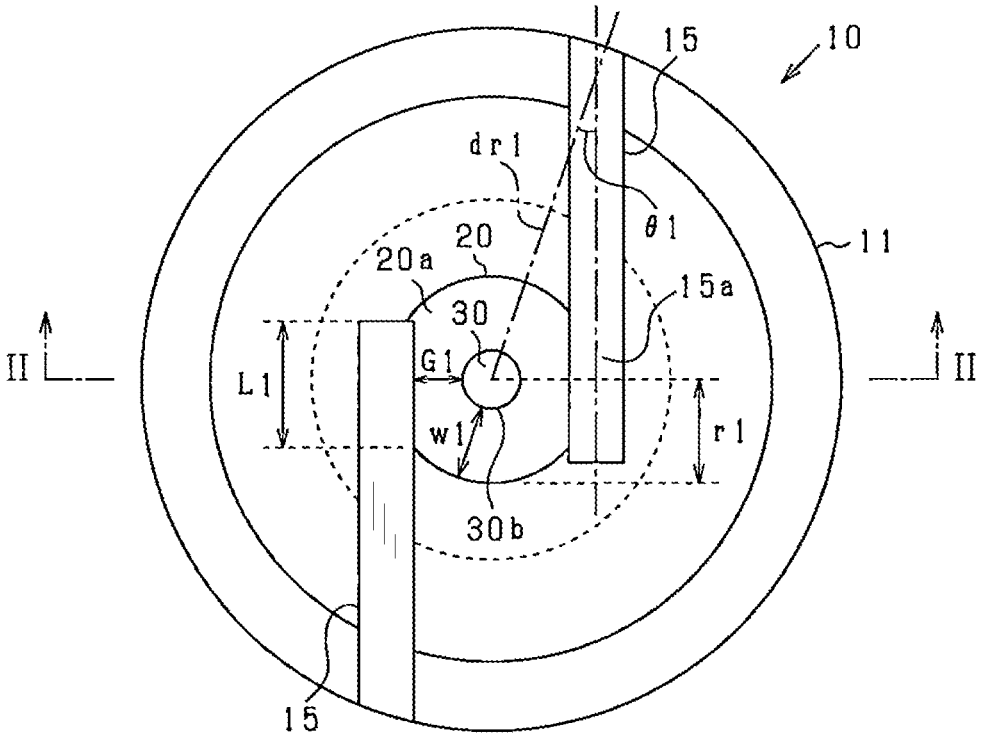
FIG. 1 is a plan view which shows a head of a spark plug.
Figure 2:
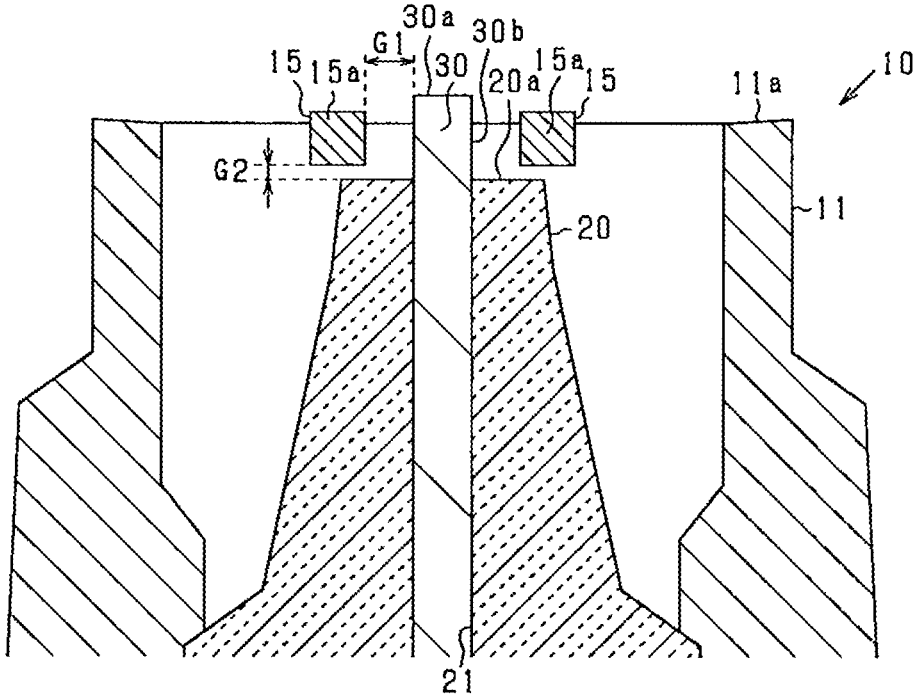
FIG. 2 is a sectional view taken along the line II-II in FIG. 1.

Referring now to the drawings, particularly to FIGS. 1 and 2, the spark plug 10 for use in a gasoline internal combustion engine according to an embodiment is shown. The spark plug 10 includes the metal shell 11, the porcelain insulator 20, the center electrode 30, and the ground electrodes 15.

The metal shell 11 is made of a metallic hollow cylinder.

The porcelain insulator 20 is made of an electrically insulating hollow cylinder. The porcelain insulator 20 is firmly installed in the metal shell 11. The porcelain insulator 20 has a tapered head whose diameter decreases toward the tip thereof. The porcelain insulator 20 has the axial hole 21 which has a length extending in the axial direction of the porcelain insulator 20.

The center electrode 30 is made of a heat-resistant nickel alloy or copper in the shape of a circular cylinder. The center electrode 30 is inserted into the axial hole 21 of the porcelain insulator 20 and firmly retained therein. The center electrode 30 has the head 30*a* (i.e., a tip) protruding outside both the front end surface 20*a* of the porcelain insulator 20 and the end surface 11*a* of the metal shell 11 in a lengthwise direction of the spark plug 10.

The metal shell 11 has two ground electrodes 15 welded to an end of the head thereof. The ground electrodes 15 are each made of a heat-resistant nickel alloy in the shape of a square pole extending straight. Each of the ground electrodes 15 is of a square or rectangular shape in cross section. The joints of the ground electrodes 15 to the metal shell 11 are diametrically opposed to each other. The ground electrodes 15 extend substantially perpendicular to the length of the metal shell 11 parallel to each other on opposite sides of the center electrode 30.

Specifically, in FIG. 1 where the tips of the metal shell 11 and the center electrode 30 are viewed in the longitudinal direction of the spark plug 10, each of the ground electrodes 15 extends at an angle θ1 to a line dr1, as defined to extend from the front circumference (i.e., the front end surface 11*a*9 of the metal shell 11 to the center electrode 15, more specifically, pass through the center of the joint of the ground electrode 15 to the end surface 11*a* of the metal shell 11 and the center axis of the center electrode 30. In other words, the angle θ1 is an angle which the line dr1 makes with the longitudinal center line (i.e., the length) of the ground electrode 15 on a plane extending perpendicular to the length of the spark plug 10. The angle θ1 is selected to be greater than 0° and less than 45°. Each of the ground electrodes 15 is oriented to face the side surface 30*b* of the center electrode 30 in the radial direction of the spark plug 10 and also face the front end surface 20*a* of the porcelain insulator 20 in the longitudinal direction of the spark plug 10. In other words, each of the ground electrodes 15 has the gap-defining portion 15*a* extending along the side surface 30*b* of the center electrode 30 and the front end surface 20*a* of the porcelain insulator 20.

Figure 5:
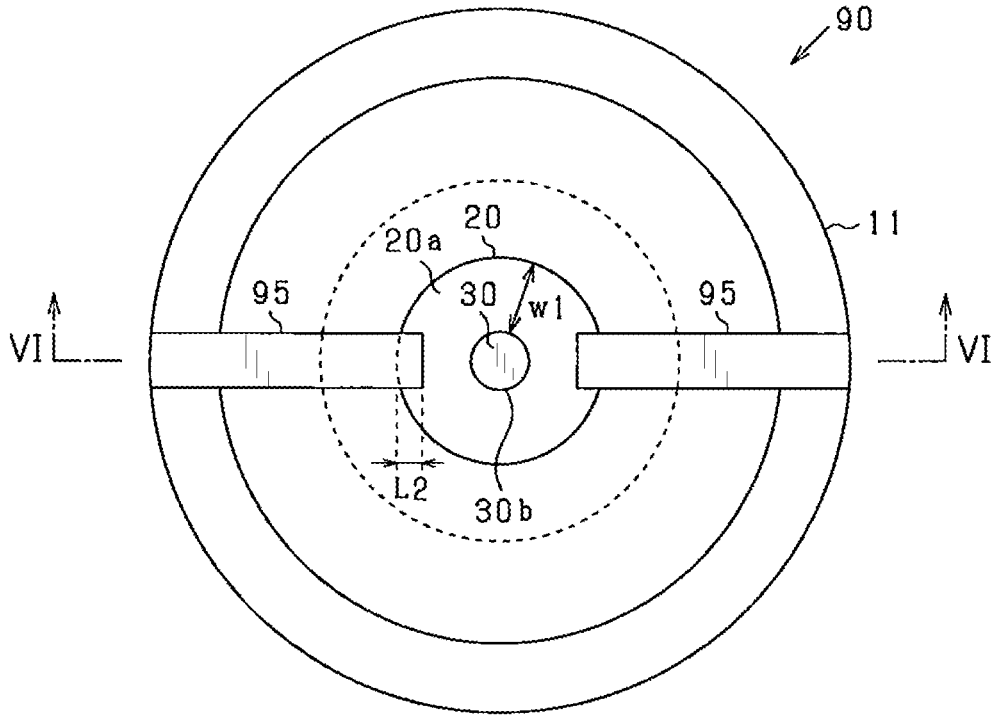
FIG. 5 is a plan view which illustrates a head of a comparative example of a spark plug.
Figure 6:
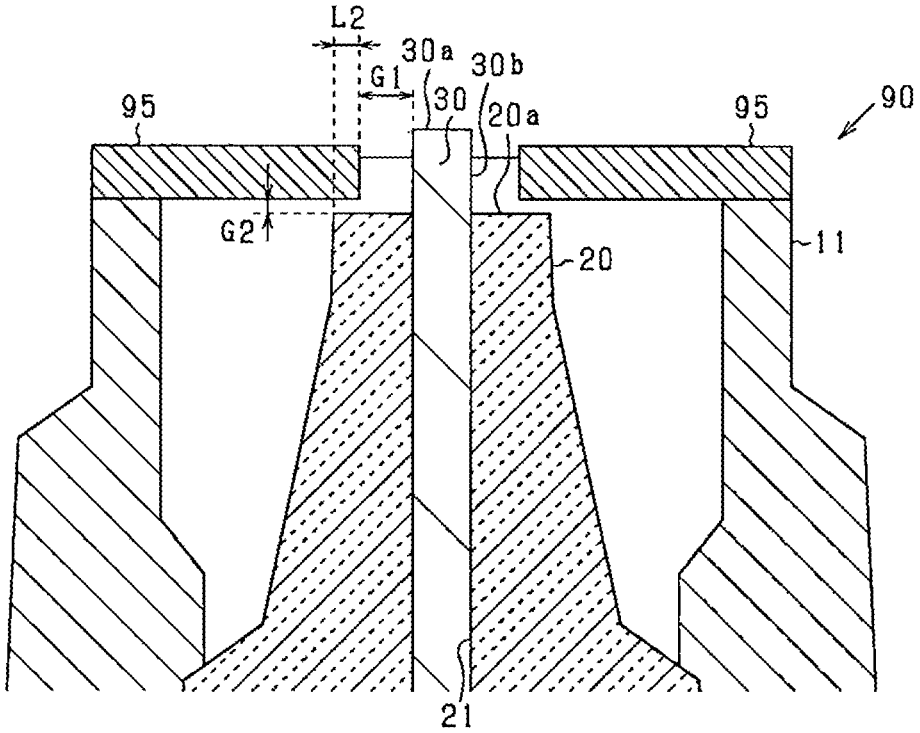
FIG. 6 is a sectional view taken along the line VI-VI in FIG. 5.

FIG. 5 is a plan view which illustrates the tip (i.e., the ends of the metal shell 11 and the center electrode 30) of a comparative example of a spark plug 90. FIG. 6 is a cross section taken along the line VI-VI in FIG. 5. The same reference numbers as describing the spark plug 10 refer to the same parts, and explanation thereof in detail will be omitted here.

The ground electrodes 95, as illustrated in FIG. 5, extend straight from the end of the metal shell 11 toward the center electrode 30. Each of the ground electrodes 95 has a portion which faces the front end surface 20*a* of the porcelain insulator 20 and has a length L2. The length L2 is less than or equal to the width W1 of the front end surface 20*a* in the radial direction of the porcelain insulator 20.

The spark plug 10 of this embodiment, as clearly illustrated in FIG. 1, has the gap-defining portion 15*a* of each of the ground electrodes 15. The gap-defining portion 15*a* has a length L1 which extends along the front end surface 20*a* of the porcelain insulator 20, in other words, faces the front end surface 20*a* in the longitudinal direction of the porcelain insulator 20. The length L1 is selected to be greater than the width W1 of the front end surface 20*a* in the radial direction of the porcelain insulator 20. Specifically, the length L1 of the gap-defining portion 15*a* which extends along or faces the front end surface 20*a* of the porcelain insulator 20 is selected to be longer than a half r1 of an outer diameter of the porcelain insulator 20.

A sparking air gap G1 (which will also be referred to as a spark gap or a first gap) is created between the side surface 30*b* of the center electrode 30 and the gap-defining portion 15*a* of each of the ground electrodes 15. The spark gap G1 is a minimum interval between the side surface 30*b* of the center electrode 30 and the gap-defining portion 15*a*. The spark gap G1 is selected lie in a range of 0.4 mm to 0.8 mm (i.e., 0.4 mm≤G1≤0.8). In other words, the spark gap G1 is selected to be a typical air gap whose size is large enough to properly create a sequence of sparks between the side surface 30*b* of the center electrode 30 and the gap-defining portion 15*a* in a normal operating mode of the spark plug 10.

A semi-surface discharge gap G2 (which will also be referred to as a spark gap or a second gap) is created between the front end surface 20*a* of the porcelain insulator 20 and the gap-defining portion 15*a* of each of the ground electrodes 15. The spark gap G2 is a minimum interval between the front end surface 20*a* of the porcelain insulator 20 and the gap-defining portion 15*a*. The spark gap G2 is selected lie in a range of 0.2 mm to the spark gap G1 (i.e., 0.2 mm≤G2≤G1). The insulation resistance of the porcelain insulator 20 usually drops with a rise in temperature thereof. The spark gap G2 is engineered to have a size large enough to stop the semi-surface discharge from being developed through the spark gap G2 on the front end surface 20*a* of the porcelain insulator 20 when the insulation resistance of the porcelain insulator 20 is decreased with an increase in temperature thereof.

Figure 3:
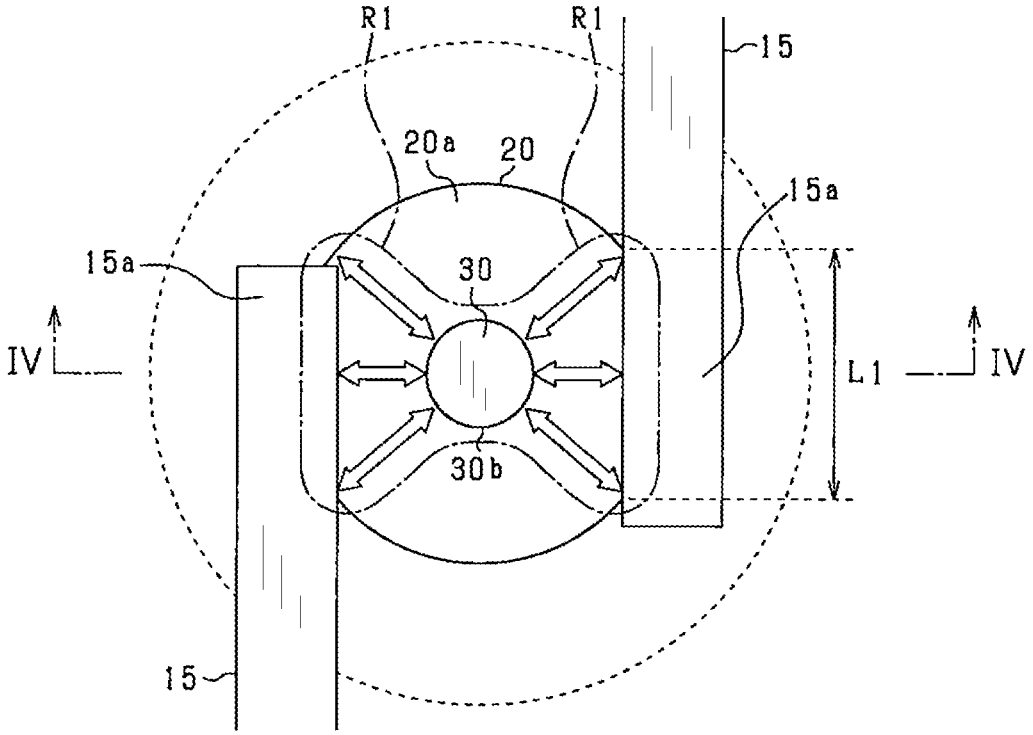
FIG. 3 is a plan view which illustrates paths of semi-surface discharge developed on the spark plug of FIG. 1.
Figure 4:
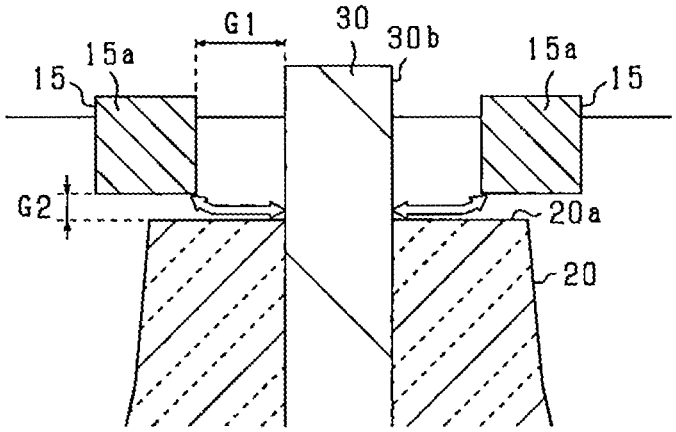
FIG. 4 is a sectional view taken along the line IV-IV in FIG. 3.

FIG. 3 is a plan view which demonstrates paths of the semi-surface discharge. FIG. 4 is a sectional view taken long the line IV-IV in FIG. 3.

In the normal operating mode where the amount of carbon deposits accumulated on the front end surface 20*a* of the porcelain insulator 20 is small, a spark is created in the spark gap G1 between the side surface 30*b* of the center electrode 30 and the gap-defining portion 15*a* of each of the ground electrodes 15. This ignites an air-fuel mixture (i.e. a mixture of gasoline and air) in the engine.

In a fouling mode where the amount of carbon deposits on the front end surface 20*a* of the porcelain insulator 20 is great, the semi-surface discharge is created, as indicated by arrows, through the spark gap G2 on the front end surface 20*a* of the porcelain insulator 20 between the side surface 30*b* of the center electrode 30 and the gap-defining portion 15*a* of each of the ground electrodes 15. The spark gap G2 is, as described above, smaller in size than the spark gap G1, thereby causing sparks to be created in the spark gap G2 along the front end surface 20*a* of the porcelain insulator 20 in the semi-surface discharge mode (i.e., the fouling mode) without generating sparks within the spark gap G1 in the normal operating mode. This burns off the carbon deposits on the front end surface 20*a* of the porcelain insulator 20.

Figure 7:
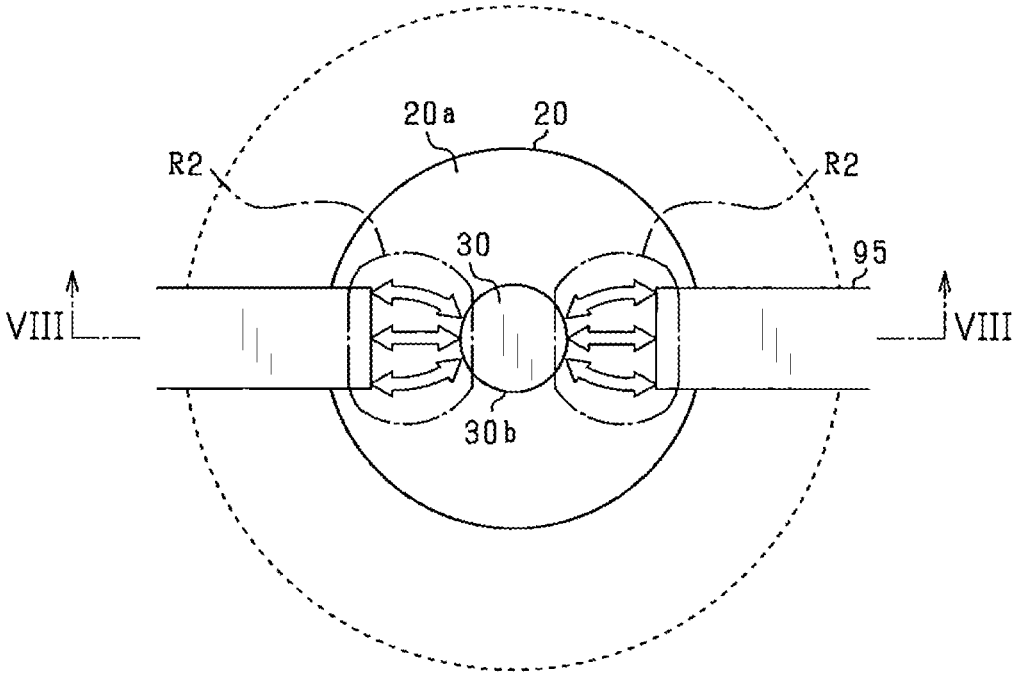
FIG. 7 is a plan view which illustrates paths of semi-surface discharge developed on the spark plug of FIG. 5.
Figure 8:
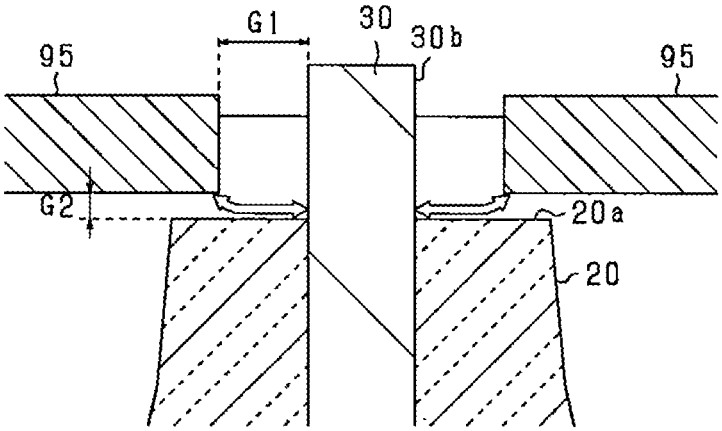
FIG. 8 is a sectional view taken along the line VIII-VIII in FIG. 6.

The gap-defining portion 15*a*, as described above, extends a distance equivalent to the length L1 over the front end surface 20*a* of the porcelain insulator 20. In other words, the gap-defining portion 15*a* is exposed to the front end surface 20*a* in a wide range equivalent to the length L1. This results in, as indicated arrows in FIG. 3, increased lengths of the paths along which the semi-surface discharge is created on the front end surface 20*a* of the porcelain insulator 20 in the fouling mode. This enables the carbon deposits on the front end surface 20*a* of the porcelain insulator 20 to be burned out in a wide range R1, as indicated by a broken line in FIG. 3, FIG. 7 is a plan view which demonstrates a comparative example of paths of sparks in the semi-surface discharge mode. FIG. 8 is a sectional view taken along the line VIII-VIII in FIG. 7.

In the comparative example, in the normal operating mode where a small amount of carbon deposit is on the front end surface 20*a* of the porcelain insulator 20, sparks are produced in the gap G1 between the side surface 30*b* of the center electrode 30 and the gap-defining portion 15*a*, thereby igniting the air-fuel mixture in the engine.

In the fouling mode where there is a large amount of carbon deposit on the front end surface 20*a* of the porcelain insulator 20, the semi-surface discharge is created, as indicated by arrows, through the spark gap G2 on the front end surface 20*a* of the porcelain insulator 20 between the side surface 30*b* of the center electrode 30 and the gap-defining portion 15*a* of each of the ground electrodes 15. In the comparative example, the spark gap G2 is smaller in size than the spark gap G1, thereby causing sparks to be created in the spark gap G2 along the front end surface 20*a* of the porcelain insulator 20 in the semi-surface discharge mode (i.e., the fouling mode) without generating sparks within the spark gap G1.

However, in the comparative example, the ground electrodes 95 extend from the end of the metal shell 11 straight to the center electrode 30, so that the interval between the front end surface 20*a* of the porcelain insulator 20 and the ground electrodes 95 is smaller than that in the spark plug 10 in this embodiment. This causes sparks to be developed with shorter lengths of the paths, as indicated by arrows in FIG. 7, than in FIG. 3, so that the carbon deposits on the front end surface 20*a* of the porcelain insulator 20 are burned out only in narrow ranges R2, as indicated by broken lines in FIG. 7, which leads to an insufficient amount of carbon deposit burned off on the front end surface 20*a* of the porcelain insulator 20.

The structure of the spark plug 10 in the embodiment offers the following beneficial advantages.

The head 30*a* of the center electrode 30, as described above, protrudes outside the front end surface 20*a* of the porcelain insulator 20 in the lengthwise direction of the spark plug 10. Each of the ground electrodes 15 has the gap-defining portion 15*a* which extends along the side surface 30*b* of the center electrode 30 and the front end surface 20*a* of the porcelain insulator 20, in other words, which faces the side surface 30*b* of the center electrode 30 in the radial direction of the spark plug 10 and also faces the front end surface 20*a* of the porcelain insulator 20 in the lengthwise direction of the spark plug 10. This creates the spark gap G1 between the side surface 30*b* of the center electrode 30 and the gap-defining portion 15*a* of each of the ground electrodes 15 and also creates the spark gap G2 between the front end surface 20*a* of the porcelain insulator 20 and the gap-defining portion 15*a* of each of the ground electrodes 15, thereby causing sparks to be developed in the spark gaps G1 to ignite the air-fuel mixture in the engine in the normal operating mode where a small amount of carbon deposit is on the front end surface 20*a* of the porcelain insulator 20.

When the amount of carbon deposit on the front end surface 20*a* of the porcelain insulator 20 becomes large, the fouling mode is entered. The spark plug 10 then works to create sparks in the spark gaps G2 along the front end surface 20*a* of the porcelain insulator 20 in the semi-surface discharge mode to burn off the carbon deposits on the front end surface 20*a* of the porcelain insulator 20. Each of the gap-defining portions 15*a* extends over the front end surface 20*a* of the porcelain insulator 20 in a direction substantially perpendicular to the center axis of the porcelain insulator 20, thereby resulting in an increased region where the front end surface 20*a* of the porcelain insulator 20 directly faces the gap-defining portion 15*a*, which leads to increased lengths of the paths in which sparks are developed along the front end surface 20*a* of the porcelain insulator 20 in the fouling mode, thereby enhancing the ability of the spark plug 10 to burn off carbon deposits on the front end surface 20*a* of the porcelain insulator 20.

In FIG. 1 where the tips of the metal shell 11 and the center electrode 30 are viewed in the longitudinal direction of the spark plug 10, each of the ground electrodes 15 extends at the angle θ1 to the line dr1, as defined to pass through the center of the joint of the ground electrode 15 to the end surface 11*a* of the metal shell 11 and the center of the center electrode 30. The angle θ1 is selected to be greater than 0° and less than 45°. Each of the ground electrodes 15 is oriented to face the side surface 30*b* of the center electrode 30 in the radial direction of the spark plug 10 and also face the front end surface 20*a* of the porcelain insulator 20 in the longitudinal direction of the spark plug 10. These arrangements result in an increase in the length L1 of each of the ground electrodes 15 which faces or overlaps the front end surface 20*a* of the porcelain insulator 20 in the longitudinal direction of the spark plug 10 as compared with the example in FIG. 5 wherein the ground electrodes 95 extend from the end of the metal shell 11 straight toward the center electrode 30 in opposite radial directions of the spark plug 90. The structure of the spark plug 10 in the embodiment, therefore, has the long paths in which the semi-surface discharge is developed over the front end surface 20*a* of the porcelain insulator 20 when the front end surface 20*a* is fouled, thereby enhancing the ability of the spark plug 10 to burn off carbon deposits on the front end surface 20*a* of the porcelain insulator 20.

The length L1 of each of the gap-defining portions 15*a* which directly faces the front end surface 20*a* of the porcelain insulator 20 is, as described above, selected to be greater than the width W1 of the front end surface 20*a* of the porcelain insulator 20 in the radial direction of the porcelain insulator 20. This results in increased lengths of the paths of the semi-surface discharge along the front end surface 20*a* of the porcelain insulator 20 in the fouling mode, thereby improving the ability of the spark plug 10 to burn off carbon deposits on the front end surface 20*a* of the porcelain insulator 20.

The length L1 of each of the gap-defining portions 15*a* extending over or facing the front end surface 20*a* of the porcelain insulator 20 in the longitudinal direction of the spark plug 10 is greater than the half r1 of the outer diameter of the porcelain insulator 20, thereby resulting in increased lengths of the paths in which sparks are discharged in the semi-surface discharge mode along the front end surface 20*a* of the porcelain insulator 20 This improves the ability of the spark plug 10 to burn off carbon deposits on the front end surface 20*a* of the porcelain insulator 20.

The spark gap G1 that is a minimum air gap between the side surface 30*b* of the center electrode 30 and the gap-defining portion 15*a* of each of the ground electrodes 15 is greater than or equal to 0.4 mm and less than or equal to 0.8 mm. This ensures the stability in creating sparks between the side surface 30*b* of the center electrode 30 and the gap-defining portion 15*a* in the normal operating mode of the spark plug 10.

The spark gap G2 that is a minimum air gap between the front end surface 20*a* of the porcelain insulator 20 and the gap-defining portion 15*a* of each of the ground electrodes 15 is selected to be 0.2 mm or more. This eliminates a probability that the semi-surface discharge is undesirably developed in the spark gaps G2 along the front end surface 20*a* of the porcelain insulator 20 when the insulation resistance of the porcelain insulator 20 is decreased with an increase in temperature thereof. The spark gaps G2 are smaller in size than the spark gaps G1, thereby causing the semi-surface discharge to be initiated in the spark gaps G2 when the fouling mode is entered without generating sparks in the spark gaps G1.

Each of the ground electrodes 15 is shaped to extend straight, thus facilitating the ease with which the ground electrodes 15 are produced.

The spark plug 10 is, as described above, equipped with the two ground electrodes 15 which extend parallel on opposite sides of the center electrode 30. This results in an increased region in which the ground electrodes 15 face the front end surface 20*a* of the porcelain insulator 20 as compared with when the spark plug 10 is designed to have only one ground electrode 15, thereby enhancing the ability of the spark plug 10 to burn off carbon accumulated on the front end surface 20*a* of the porcelain insulator 20.

The two ground electrodes 15 extend from portions of the circumference (i.e., a circumferential edge) of the metal shell 11 which are diametrically opposed to each other across the longitudinal center of the spark plug 10 (i.e., the metal shell 11). In other words, the joints of the ground electrodes 15 to the metal shell 11 are located farther away from each other than when the ground electrodes 15 extend from portions of the circumference of the metal shell 11 which are not diametrically opposed to each other. This facilitates the ease with which the ground electrodes 15 are joined to the metal shell 11 in the production process of the spark plug 10 as compared with when the ground electrodes 15 extend from portions of the metal shell which are located closer to each other in the circumferential direction of the metal shell.

The structure of the spark plug 10 may be modified in the following ways. In the following discussion, the same reference numbers as employed in the above embodiment will refer to the same parts, and explanation thereof in detail will be omitted here.

Figure 9:
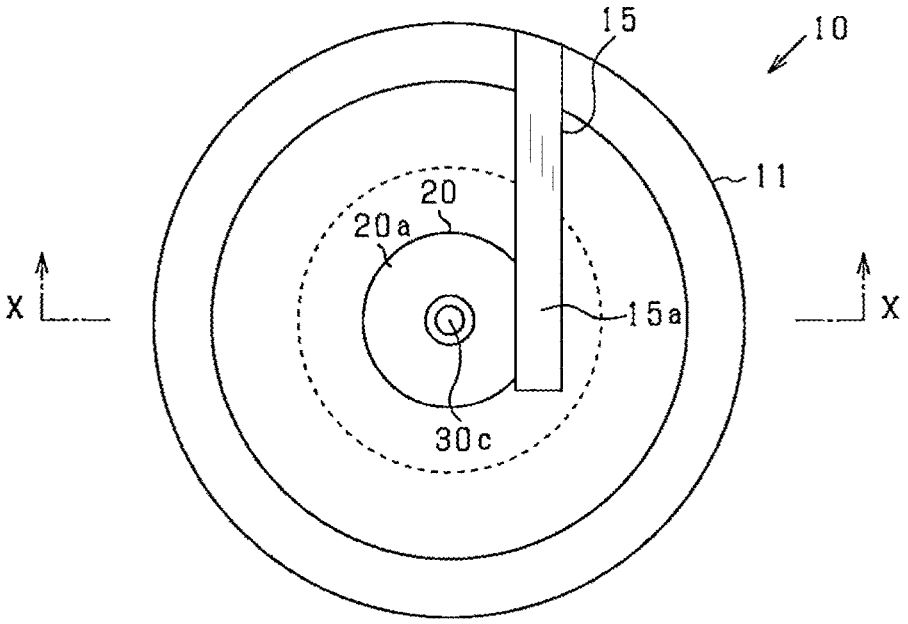
FIG. 9 is a plan view which illustrates a modification of a spark plug.
Figure 10:
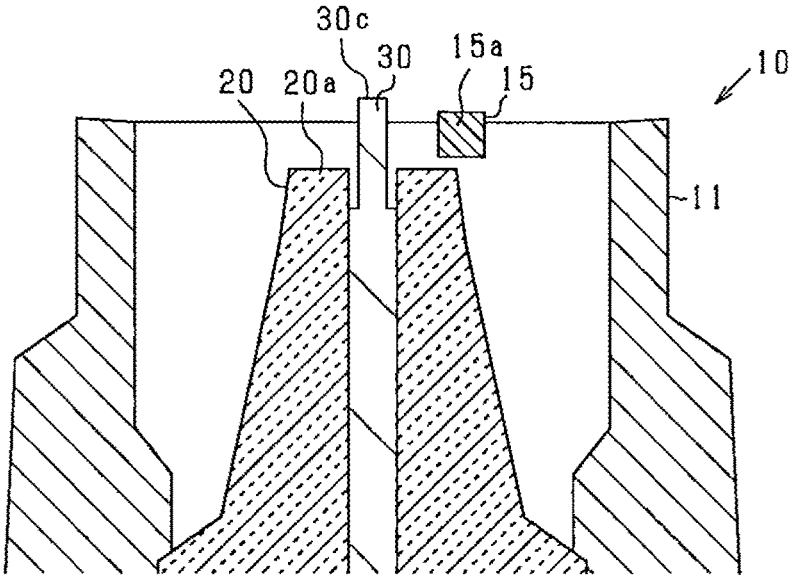
FIG. 10 is a sectional view taken along the line X-X in FIG. 9.

The spark plug 10 may be, as illustrated in FIGS. 9 and 10, designed to have a single ground electrode 15. The gap-defining portion 15*a*, like in the above embodiment, extends along the front end surface 20*a* of the porcelain insulator 20, thereby resulting in an increased region where the front end surface 20*a* of the porcelain insulator 20 directly faces the gap-defining portion 15*a*. The center electrode 30 may, as shown in FIG. 10, have the small-diameter portion 30*c* which has a diameter smaller than that of a major body of the center electrode 30. The small-diameter portion 30*c* defines an air gap between an outer periphery thereof and an inner periphery of the porcelain insulator 20.

Figure 11:
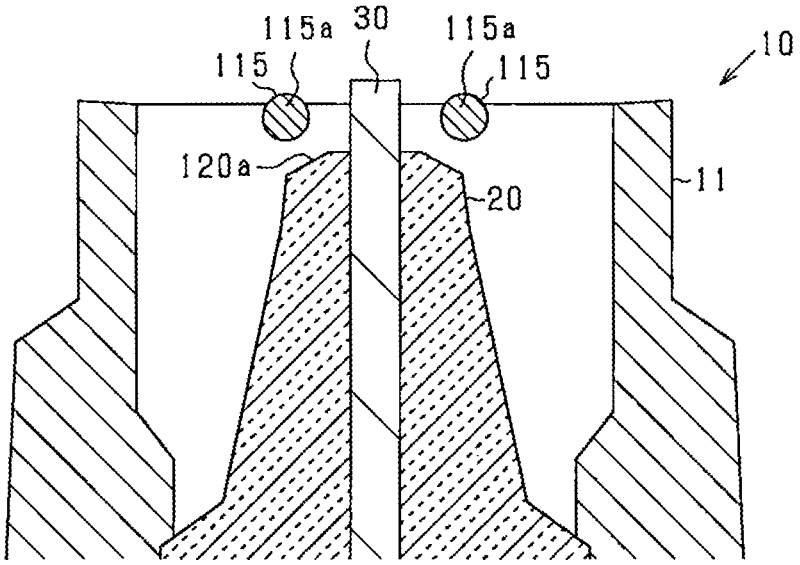
FIG. 11 is a sectional view which illustrates a modification of a spark plug.

The spark plug 10 may alternatively be, as illustrated in FIG. 11, designed to have two ground electrodes 115 each of which is made of a straight extending cylindrical bar. Specifically, each of the ground electrodes 115 is circular in cross section. The gap-defining portion 115*a* extends along or faces the front end surface 120*a* of the porcelain insulator 20, thereby resulting in an increased region where the front end surface 120*a* of the porcelain insulator 20 directly faces the gap-defining portion 115*a*. Each of the ground electrodes 115 may alternatively be made to have a groove formed therein. This results in an increase in number of edges of a cross section of the ground electrode 115, which leads to an increase in portions of the ground electrode 115 on which an electric field concentrates, thus facilitating the discharge from the spark plug 10. The front end surface 120*a* of the porcelain insulator 20 may, as illustrated in FIG. 11, have an annular tapered portion which is inclined at a given angle relative to a plane extending perpendicular to the center axis of the porcelain insulator 20 (i.e., the center electrode 30).

Figure 12:
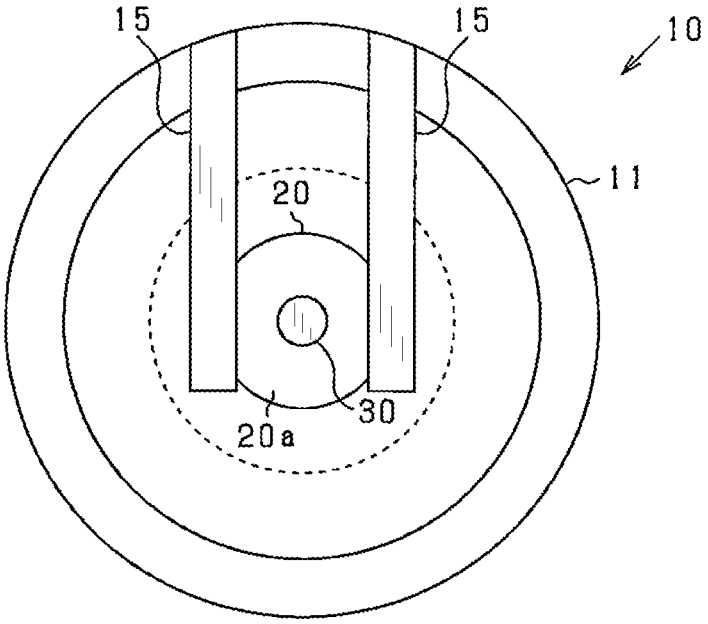
FIG. 12 is a plan view which illustrates a modification of a spark plug.

The spark plug 10 may alternatively be, as illustrated in FIG. 12, designed to have two ground electrodes 15 which extend from portions of the end of the metal shell 11 which are not diametrically opposed to each other, but located adjacent each other in the circumferential direction of the metal shell 11. The ground electrodes 15 extend substantially parallel to each other on opposite sides of the center electrode 30. In other words, the ground electrodes 15 face each other across the center electrode 30 in the radial direction of the spark plug 10. Such arrangements of the ground electrodes 15, like in the above embodiment, result in an increased region where the front end surface 20*a* of the porcelain insulator 20 directly faces the ground electrodes 15 as compared with when the spark plug 10 has only one ground electrode 15.

Figure 13:
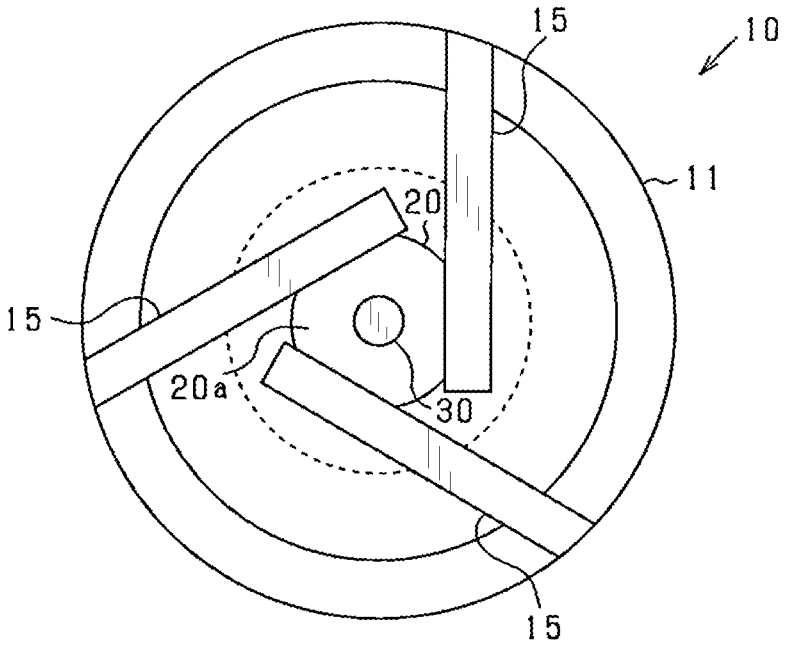
FIG. 13 is a plan view which illustrates a modification of a spark plug.

The spark plug 10 may be, as illustrated in FIG. 13, designed to have three ground electrodes 15 straight extending from the circumference end of the metal shell 11 toward the center electrode 30. Joints of the ground electrodes 15 to the metal shell 11 may be located at a given angular interval away from each other in the circumferential direction of the metal shell 15. The use of the three ground electrodes 15 results in an increased region the front end surface 20*a* of the porcelain insulator 20 faces the ground electrodes 15 as compared with use of two ground electrodes 15. The spark plug 10 may alternatively be equipped with four or more ground electrodes 15 extending from the end of the metal shell 11 to the center electrode 30.

Figure 14:
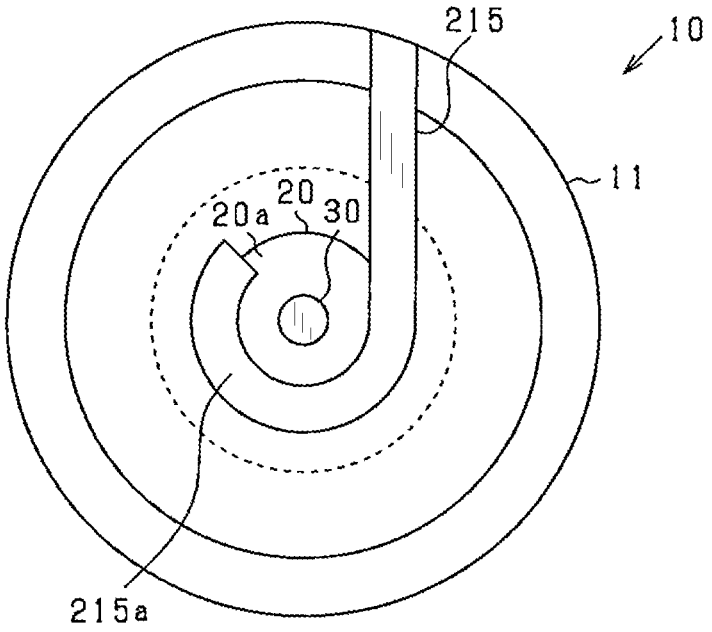
FIG. 14 is a plan view which illustrates a modification of a spark plug.

The spark plug 10 may be, as illustrated in FIG. 14, equipped with the ground electrode 215 with the J-shaped gap-defining portion 215*a*. The gap-defining portion 215*a* is curved in the form of an arc surrounding the center electrode 30. In other words, the gap-defining portion 215*a* has an inner surface directly facing the outer periphery of the center electrode 30 and a lower surface directly facing the front end surface 20*a* of the porcelain insulator 20. Such a configuration of the gap-defining portion 215*a* results in an increased region where the front end surface 20*a* of the porcelain insulator 20 faces the gap-defining portion 215*a* of the ground electrode 215.

Figure 15:
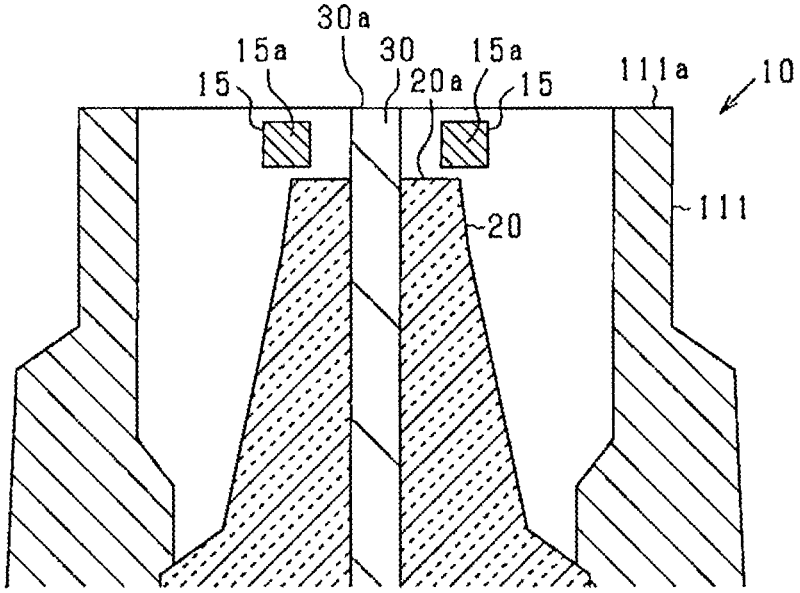
FIG. 15 is a sectional view which illustrates a modification of a spark plug.

The spark plug 10 may be, as illustrated in FIG. 15, designed to have the center electrode 30 whose head 30*a* protrudes from the front end surface 20*a* of the porcelain insulator 20, but is located inside the end surface 111*a* of the metal shell 111 in the longitudinal direction of the spark plug 10. In other words, the head 30*a* does not have to protrude outside the end surface 111*a* of the metal shell 111 in the longitudinal direction of the spark plug 10.

What is claimed is:

1. A spark plug comprising:

a cylindrical metal shell;

a cylindrical porcelain insulator which is retained inside the metal shell;

a center electrode which is disposed inside the porcelain insulator to have a head protruding outside a front end surface of the porcelain insulator; and a ground electrode which is joined to the metal shell and has a gap-defining portion, the gap-defining portion extending over a side surface of the center electrode and the front end surface of the porcelain insulator; wherein the gap-defining portion defines a first gap that is a minimum gap between the gap-defining portion and the side surface of the center electrode, the first gap being selected to be more than or equal to 0.4 mm and less than or equal to 0.8 mm, and wherein the gap-defining portion defines a second gap that is a minimum gap between the gap-defining portion and the front end surface of the porcelain insulator, the second gap being selected to be more than or equal to 0.2 mm and less than or equal to the first gap.

2. A spark plug as set forth in claim 1, wherein the gap-defining portion has a length which extends over the front end surface of the porcelain insulator and the length is selected to be greater than a width of the front end surface of the porcelain insulator in a radial direction of the porcelain insulator.

3. A spark plug as set forth in claim 1, wherein the gap-defining portion has a length which extends over the front end surface of the porcelain insulator and is selected to be greater than half an outer diameter of the porcelain insulator.

4. A spark plug as set forth in claim 1, wherein the ground electrode is shaped to straight extend.

5. A spark plug as set forth in claim 4, further comprising a second ground electrode extending parallel to a first ground electrode that is said ground electrode, the first ground electrode and the second ground electrode being on opposite sides of the center electrode.

6. A spark plug as set forth in claim 5, wherein the first and second ground electrodes extend from portions of the metal shell which are diametrically opposed to each other.

7. A spark plug comprising:

a cylindrical metal shell;

a cylindrical porcelain insulator which is retained inside the metal shell;

a center electrode which is disposed inside the porcelain insulator to have a head protruding outside a front end surface of the porcelain insulator; and a ground electrode which extends at a given angle to a line, as defined to extend from a front circumference of the metal shell to the center electrode, when tips of the metal shell and the center electrode are viewed in a longitudinal direction of the spark plug, the given angle being selected to be greater than 0° and less than 45°, the ground electrode being oriented to face a side surface of the center electrode and the front end surface of the porcelain insulator, wherein the ground electrode is joined to the metal shell and has a gap-defining portion, the gap-defining portion extending over the side surface of the center electrode and the front end surface of the porcelain insulator;

the gap-defining portion defines a first gap that is a minimum gap between the gap-defining portion and the side surface of the center electrode, the first gap being selected to be more than or equal to 0.4 mm and less than or equal to 0.8 mm, and wherein the gap-defining portion defines a second gap that is a minimum gap between the gap-defining portion and the front end surface of the porcelain insulator, the second gap being selected to be more than or equal to 0.2 mm and less than or equal to the first gap.

8. A spark plug as set forth in claim 7, wherein the ground electrode has a length which extends over the front end surface of the porcelain insulator and is selected to be greater than a width of the front end surface of the porcelain insulator in a radial direction of the porcelain insulator.

9. A spark plug as set forth in claim 7, wherein the ground electrode has a length which extends over the front end surface of the porcelain insulator and is selected to be greater than half an outer diameter of the porcelain insulator.

10. A spark plug as set forth in claim 7, wherein the ground electrode is shaped to extend straight.

11. A spark plug as set forth in claim 10, further comprising a second ground electrode extending parallel to a first ground electrode that is said ground electrode on opposite sides of the center electrode.

12. A spark plug as set forth in claim 11, wherein the first and second ground electrodes extend from portions of the metal shell which are diametrically opposed to each other.

* * * * *